US007752872B2

(12) United States Patent
Fumagalli

(10) Patent No.: US 7,752,872 B2
(45) Date of Patent: Jul. 13, 2010

(54) BASKET FOR WASHING MACHINE, WASHER-DRYER, DRYER AND THE LIKE

(75) Inventor: Silvano Fumagalli, Milan (IT)

(73) Assignee: Candy S.p.A., Monza, (Milano) (IT)

( * ) Notice: Subject to any disclaimer, the term of this patent is extended or adjusted under 35 U.S.C. 154(b) by 416 days.

(21) Appl. No.: 11/822,257

(22) Filed: Jul. 3, 2007

(65) Prior Publication Data

US 2008/0006065 A1 Jan. 10, 2008

(30) Foreign Application Priority Data

Jul. 6, 2006 (EP) ..... 06425468

(51) Int. Cl.
*D06F 37/06* (2006.01)

(52) U.S. Cl. ..... 68/24; 68/58; 68/140; 68/232

(58) Field of Classification Search ..... 68/24, 68/58, 140, 232
See application file for complete search history.

(56) References Cited

U.S. PATENT DOCUMENTS

| | | | | | |
|---|---|---|---|---|---|
| 1,020,618 | A | * | 3/1912 | Miller | 68/142 |
| 2,213,453 | A | * | 9/1940 | Schmidt | 452/123 |
| 2,286,429 | A | * | 6/1942 | Meyer et al. | 68/58 |
| 2,334,025 | A | * | 11/1943 | O'Neill | 34/85 |
| 2,343,743 | A | * | 3/1944 | Breckenridge | 68/208 |
| 2,584,070 | A | * | 1/1952 | Walker | 68/58 |
| 2,651,509 | A | * | 9/1953 | Hyman | 34/108 |
| 2,727,315 | A | * | 12/1955 | Candor | 34/543 |
| 2,734,368 | A | * | 2/1956 | Richardson | 68/142 |
| 3,111,017 | A | * | 11/1963 | Searle | 68/12.05 |
| 3,605,281 | A | * | 9/1971 | Hubbard et al. | 34/599 |
| 3,815,258 | A | * | 6/1974 | Beard, Jr. | 34/602 |
| 3,938,260 | A | * | 2/1976 | Brenner et al. | 34/108 |
| 4,881,385 | A | * | 11/1989 | Lambrechts | 68/29 |
| 4,971,449 | A | * | 11/1990 | Hendren | 366/228 |
| 5,275,026 | A | * | 1/1994 | Chilcoat | 68/58 |
| 5,862,687 | A | * | 1/1999 | Jang | 68/142 |
| 2004/0244438 | A1 | * | 12/2004 | North | 68/23.2 |

FOREIGN PATENT DOCUMENTS

| | | | |
|---|---|---|---|
| DE | 1 144 226 | | 2/1963 |
| DE | 2 306 873 | * | 8/1974 |
| DE | 23 63 935 | * | 7/1975 |
| DE | 102 60 023 | | 1/2004 |
| EP | 0 806 513 | | 11/1997 |
| JP | 54-104660 | * | 8/1979 |
| JP | 02-063500 | * | 3/1990 |
| JP | 06-047194 | * | 2/1994 |
| JP | 11-076679 | * | 3/1999 |
| WO | WO 01/61098 | | 8/2001 |

* cited by examiner

*Primary Examiner*—Frankie L Stinson
(74) *Attorney, Agent, or Firm*—Dickstein Shapiro LLP

(57) ABSTRACT

A loading basket for a washing machine includes a rear wall (8), a front wall (9) and a side wall (7) extending about a longitudinal axis (X), and one or more dragging blades (12) that are arranged on the side wall (7) and projecting to the inside of the basket. The side wall (7) includes a substantially cylindrical and/or truncated cone-shaped wall portion (13) with one or more approximately plane interruption areas (14) extending from a rear area of the side wall (7) close to the rear wall (8) to the vicinity of the front wall (9). The dragging blades (12) are connected to the interruption areas (14).

18 Claims, 6 Drawing Sheets

BASKET FOR WASHING MACHINE, WASHER-DRYER, DRYER AND THE LIKE

FIELD OF THE INVENTION

The present invention relates to a basket for a washing machine, dryer, or washer-dryer.

BACKGROUND OF THE INVENTION

With particular reference to the known washing machines, the perforated basket, which is intended to accommodate the laundry to be washed, is rotatably arranged within a tank containing the lye. Due to the rotational movement of the basket, the laundry is agitated and caused to spin in the lye, and the lye is carried upwards by the rotating basket, from where it falls on the laundry which results to be completely immersed and soaked, such that the impurities are transferred to the washing and rinsing lye.

The basket usually consists of a rear wall by means of which the basket is secured within the washing machine, a front wall defining a loading opening through which it is possible to gain access to the interior of the basket and a side wall being generally cylindrical and perforated to allow the lye exchange between the tank and the interior of the basket. The side wall is usually formed from a steel sheet with two opposite longitudinal edges and two opposite transversal edges, which is folded about a longitudinal axis of the basket to form this cylinder and the transversal edges of which are connected to each other to keep the cylindrical shape, whereas the longitudinal edges are connected to respective outer edges of the rear and front walls to form the basket.

To increase the washing and drying performance on the laundry contained within the basket, the latter is exposed to increasingly greater loads of laundry, particularly because of an increase in the size and volume of the basket. In addition to the increase in the basket volume, attempts are made to operate baskets in washing machines with increasing rotational speeds and increasingly abrupt reversals of the direction of rotation. These operating conditions of modern washing machines and dryers imply, particularly during the spin cycle, high stress and dynamic deformations of the basket as well as the occurring of oscillations of the basket relative to the washing tank, which may result in the basket violently impacting against the wall of the washing tank housing the same. In order to certainly avoid the occurrence of these impacts, a minimum "safety" distance is required to be provided between the basket and the washing tank, any increase of the same inevitably resulting in an increase in the lye volume on the bottom of the tank, which cannot be used for washing purposes. The conflict is thus apparent between the requirement of increasing the washing performance and reducing the consumption of washing liquid and electric power required to heat this washing liquid.

To the purpose of avoiding said problems, solutions have been suggested which provide a truncated cone-shaped basket that is tapered towards the front wall or a cylindrical stepped basket that is tapered to the front wall (opposite the basket support point), such as to reduce the diameter size of the basket in that area where the oscillation width is the greatest. An example for this solution is disclosed in the European Application 044255503 by the same applicant.

It has been demonstrated, however, that these (large volume) baskets are not always suitable for use with traditional dragging blades extending in a substantially axial and rectilinear direction along the side wall of the basket. Due to the large diameter of the basket and the high number of revolutions, the tangent speed of the laundry at the blades is such that problems arise due to the laundry impacting against this type of dragging blades, which problems are not easy to control. An example is the phenomenon of instability or buckling of the side wall, which locally reverses the bending direction (known as "snap-through" of arc-shaped structures) and which is accompanied by a click-clack noise that is completely unacceptable in household appliances of this type. New solutions are thus sought for positioning and orienting the blades in order to avoid these problems. Naturally, due to the three-dimensionally curved shape of the basket side wall, a blade orientation other than the traditional one causes incompatibility problems between the shape of the blade root and the shape of the side wall and would oblige the manufacturers of washing machines and dryers to manage a range of various dragging blades according to various basket shapes and sizes.

In view of the general problems occurring in relation to large volume baskets, the general aim of the present invention is to provide a basket having such characteristics as to reconcile the requirements that have not been met or have been only partially met by the known solutions, and to the detriment of other requirements.

Within this general aim, the main object of the present invention is to provide a basket combining a high structural rigidity (against the deformations of the basket) with the possibility of allowing a different placement and orientation of the blades as compared with traditional ones without the requirement of arranging a range of various blades for various baskets.

A further object of the present invention is to avoid the problem of local instability (snap through) of the side wall at the dragging blades.

A further object of the present invention is to provide the basket with a shape that is fully consistent with what facilitates the achievement of said main objects and is further suitable to reduce the lye volume that is on the tank bottom, and which cannot be used for washing due to the safety distance between the basket and the tank.

BRIEF DESCRIPTION OF THE INVENTION

This and other objects are achieved by means of a loading basket for a washing machine, washer-dryer, dryer and the like, comprising:

- a rear wall to be secured to a support structure of the basket;
- a front wall opposite the rear wall,
- a side wall extending about a longitudinal axis being the axis of rotation of the basket, and which is connected to the rear and front walls to define an inner space of the basket,
- one or more dragging blades being arranged on the side wall and projecting to the inside of the basket, wherein the side wall comprises a substantially cylindrical and/or truncated cone-shaped wall portion, wherein said wall portion comprises one or more approximately plane interruption areas extending from a rear area of the side wall close to the rear wall to the vicinity of the front wall, wherein said dragging blades are connected to said interruption areas.

Due to the approximately plane shape of the interruption areas, the latter allow the dragging blades to be orientated and fixed in any manner, without requiring any particular shape (other than a plane shape) for the blade roots. Furthermore, the plane shape of the interruption areas allows the latter to be elastically deformed in a mere flexural manner, thus preventing instability phenomena of the snap-through type (which occur only in arc-shaped structures) from occurring in the blade areas.

Advantageous embodiments of the present invention are the object of the dependent claims.

BRIEF DESCRIPTION OF THE DRAWINGS

The characteristics and advantages of the present invention will be better appreciated from the detailed description below of several possible embodiments thereof, which are provided by way of non-limiting examples and illustrated in the annexed drawings, in which.

DETAILED DESCRIPTION OF EMBODIMENTS

Figure 1:
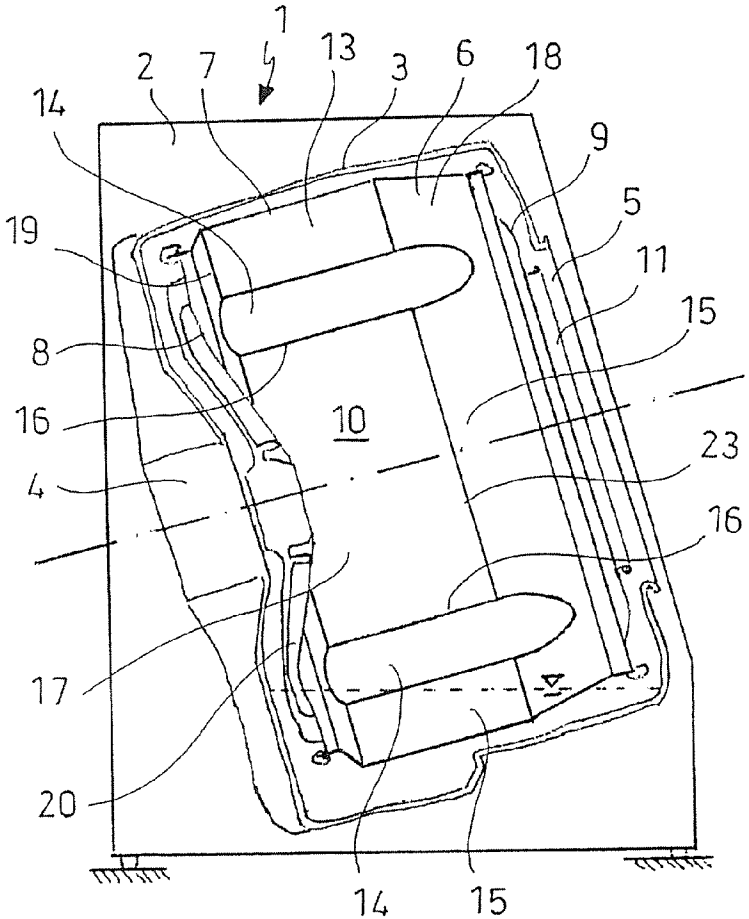
FIG. 1 is a schematic sectional view, according to a vertical middle plane, of a washing machine provided with a basket according to an embodiment of the invention.
Figure 2:
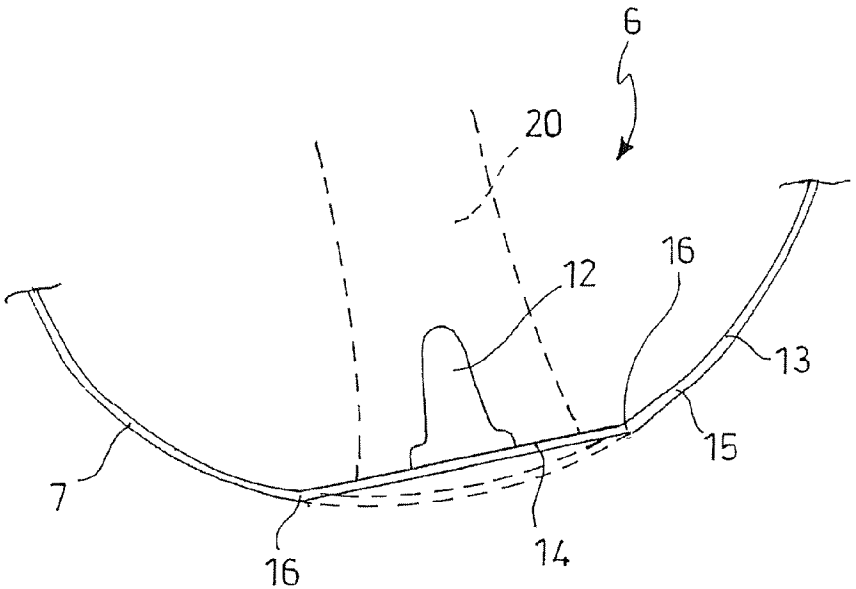
FIG. 2 is a partial cross-sectional view of a basket according to an embodiment of the invention.
Figure 3:
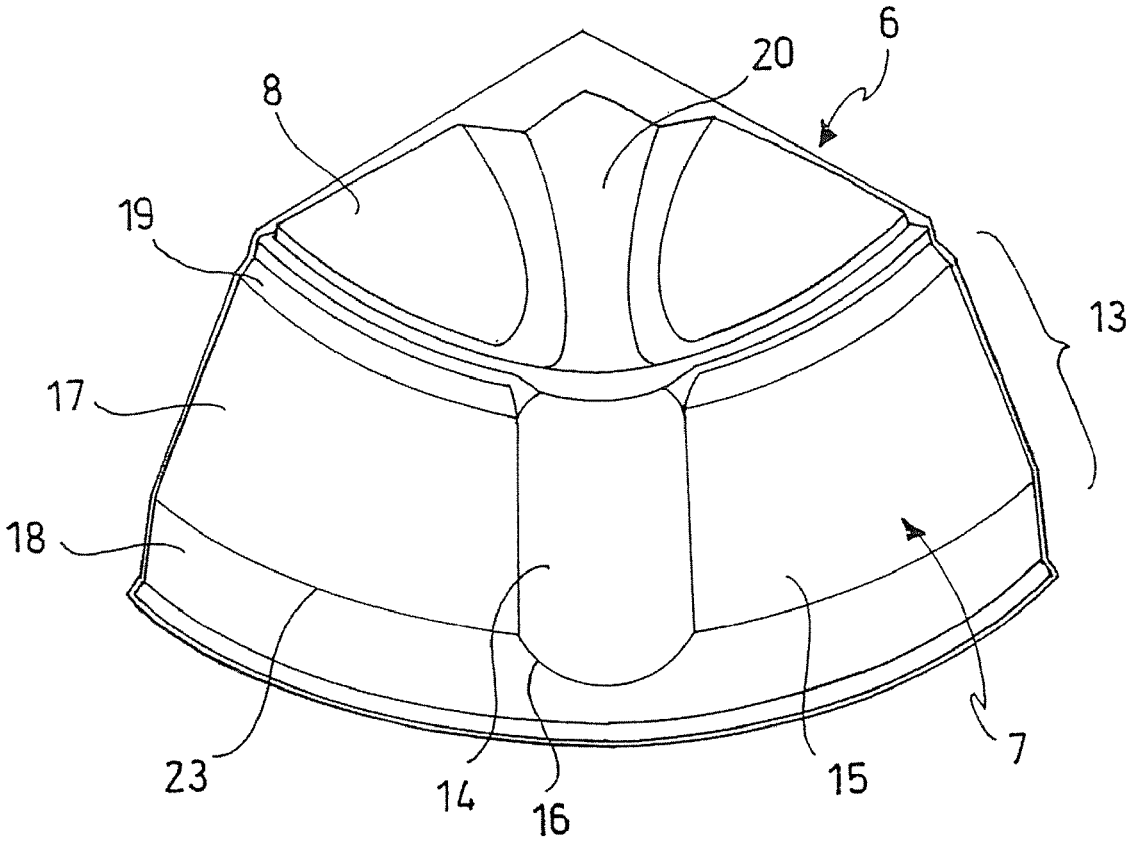
FIG. 3 is a cut-away perspective view of a basket according to an embodiment.
Figure 4:
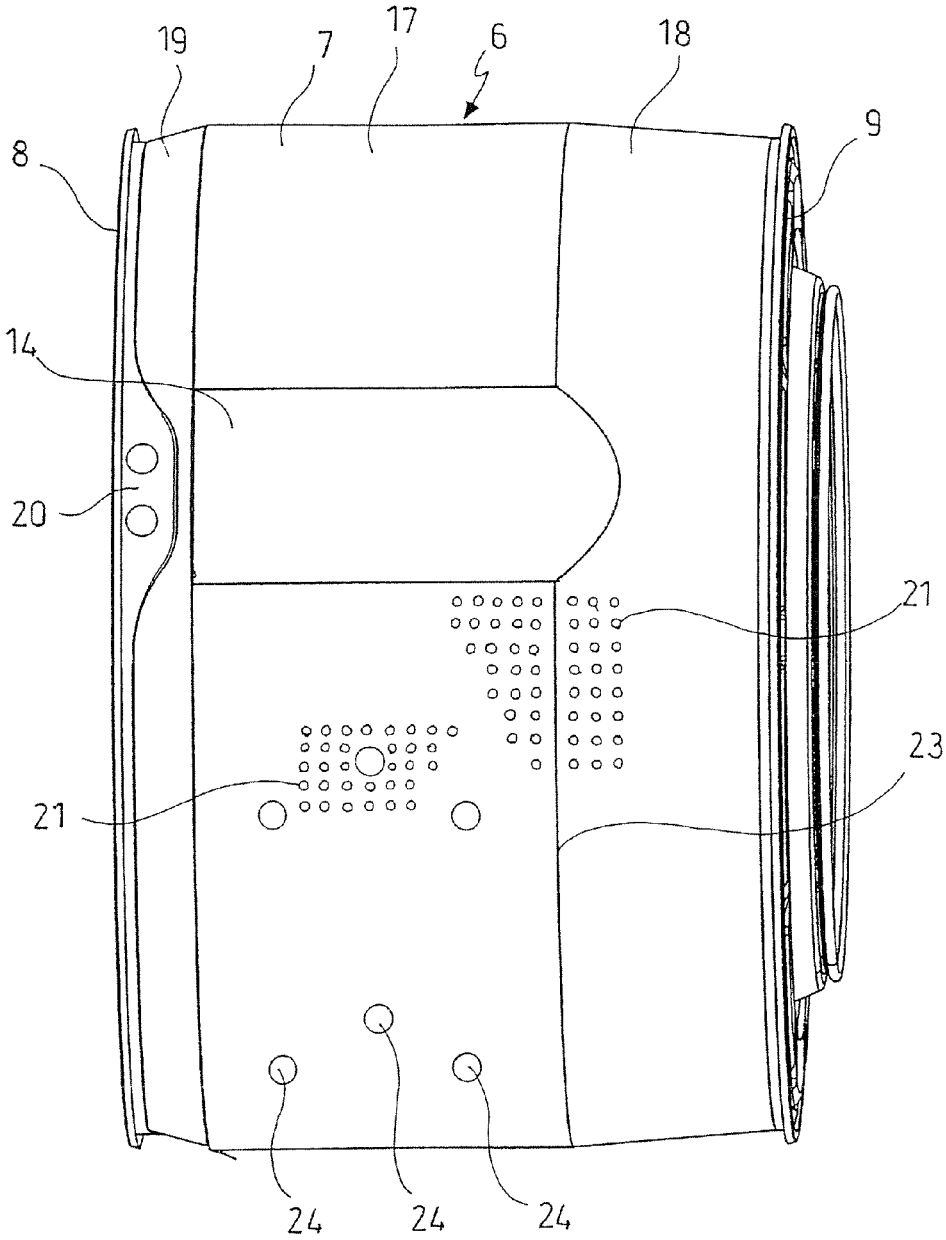
FIG. 4 is a side view of a basket according to an embodiment of the invention.

With reference to the figures, a front-loading washing machine with biased-axis tank is schematically shown in FIG. 1. Particularly, the washing machine, which is generally designated with 1, comprises a cabinet 2, a tank 3 being housed therein, which consists of a generally cylindrical body, either made of plastic or stainless steel, with either biased or horizontal longitudinal axis X (as shown in FIG. 1). The tank 3 is coupled to the cabinet 2 by means of known means, which comprise shock absorbers and suspension springs, which are not shown in order to avoid burdening the drawing.

The tank 3 is provided with a front aperture 5, having a generally round shape, which can be closed by means of a porthole being frontally hinged to the cabinet 2 and not shown, as known per se. Within the tank 3, a basket 6 is housed rotatably about the axis X, for the laundry to be accommodated therein to be washed and/or dried. The basket 6 comprises a side wall 7, a rear or bottom wall 8 and a front wall 9. The walls 7, 8 and 9 define an inner space 10 intended to accommodate the laundry to be washed and/or dried. The front wall 9 of the basket 6 is a stainless steel or plastic ring, with an aperture 11 having a generally round shape, which is placed such as to match the aperture 5 of the tank 3 to provide access to the inner space 10 to load/unload the laundry.

The rear or bottom wall 8 of the basket 6 is preferably a substantially plane, centrally drawn, steel disk, being concave towards the outside of the basket. In the middle of the rear wall 8 of the basket 6, there is mounted a support hub 4 for the basket, the basket being operatively connected therethrough to motor means (not shown), which control the rotation of the same about the longitudinal axis X.

The side wall 7 of the basket is preferably obtained from a flat steel sheet, which is bent such as to form an approximately rotational surface about a longitudinal central axis, being coincident with the longitudinal axis X of the tank 3 when in use.

The coupling of the bottom 8 and front 9 walls to the side wall 7 is preferably provided by folding two end tracts of the sheet being the side wall 7, such as to give a C-shaped profile to the steel plate at both ends thereof. The bottom 8 and front 9 walls are shaped such as to define, at the outer edges thereof, profiles matching the C-shaped profile formed at both end tracts of the side wall 7.

The basket 6 further comprises one or more, preferably three, dragging blades 12 being arranged on the side wall 7 and projecting to the inside 10 of the basket.

According to one of the main aspects of the invention, the side wall 7 comprises a substantially cylindrical and/or truncated cone-shaped wall portion 13 (such as cylindrical, truncated cone-shaped or mixed cylindrical-truncated cone shaped or mixed cylindrical-cylindrical with different diameters or mixed truncated cone-shaped with step or inverted tapering). The "continuous" cylindrical and/or truncated-cone shape of the wall portion 13 is interrupted by one or more approximately plane interruption areas 14 extending from a rear area close to the rear wall 8 to the vicinity of the front wall 9 and wherein the dragging blades 12 are fixed to the side wall of the basket at these interruption areas 14. Those skilled in the art will appreciate how the approximately plane shape of the interruption areas allows the blades 12 to be positioned and oriented as desired, without requiring any modification to the connection root in order to adapt the same to the three-dimensionally curved shapes of the prior art baskets. Furthermore, the same approximately plane shape implies a synergy effect relative to the mechanical strength of the basket, because the plane area of the side wall can be elastically flexed (to a certain restricted extent) due to the laundry tangent force on the blades, without the occurrence of buckling events that are typical on arc-shaped structures (such as snap through).

In accordance with an embodiment, the side wall 7 is shaped such that the interruption areas 14 approximately lie in a plane intersecting the cylindrical and/or truncated cone-shape of the wall portion 13 and border on adjacent continuity cylindrical and/or truncated cone-shaped areas 15 of the wall portion 13 along a folding line 16 substantially without steps or large transition areas. Particularly, along said folding line 16, the radius of the side wall 7 relative to the longitudinal axis X of the basket coincides with the corresponding radiuses both in the continuity area 15 and in the interruption area 14.

Advantageously, the approximately interruption area 14 has a slight concavity as seen from the inside of the basket. Due to this (though slight) concavity, the interruption areas 14 provide an initial shape or deformation state that is substantially complementary to an actual deformation thereof caused by the centrifuge force of the laundry mass on the side wall. Thereby, the deformations of the basket under extreme stress can be well controlled, for example during the spin cycle, thus avoiding the occurrence of unplanned and maybe irreversible deformations.

To be able of obtaining these desirable effect, the interruption areas 14 are advantageously produced by means of cold expansion of the side wall 7 from a substantially cylindrical plate ring, such that the interruption areas 14 have a greater bending radius than and the same sign as the bending radius/es of the adjacent cylindrical and/or truncated cone-shaped continuity areas 15.

In accordance with a preferred embodiment, the wall portion 13 comprises a main annular band 17, preferably cylindrical, and a cylindrical or truncated cone-shaped front annular band 18 which is arranged between the main band 17 and the front wall 9 of the basket, wherein the main band 17 has a greater average diameter than the average diameter of the front band 18 such that the barycentre of the inner volume being defined by the basket is shifted to the rear wall 8. In other words, by the basket being enlarged to the rear wall 8 thereof, the barycentre of the basket inner volume is in the rear half thereof, thus resulting in the fact that the prevailing laundry mass and the prevailing part of the centrifugal force by the latter also act in the rear half of the basket closer to the support point thereof. This contributes to a reduction in the width of the oscillations of the rotating basket.

In order to avoid negative effects of this particular basket shape on the placement and orientation and the total length of blades 12, the interruption area/s is/are advantageously formed as being approximately plane such as to overlap both the main band 17 and the front band 18.

The preferred embodiment provides that the main band 17 has a substantially cylindrical shape, except for the approximately plane interruption areas 14, and that the front band 18 has, on the other hand, a substantially truncated-cone shape with a diameter decreasing towards the front wall 9, except for the approximately plane interruption areas 14. Due to the main cylindrical band that is enlarged relative to the front band, one obtains a maximum exploitation of the depth of the washing tank and thus the lye volume in the rear areas of the tank-basket assembly in which the width of the basket oscillations is reduced and a sufficient safety distance in the front area of the basket opposite the support point thereof, where on the contrary the oscillation width is maximum. It should be pointed out herein that the main cylinder-front cone combination is particularly suitable for the optimum exploitation of the lye volume accommodated within the tank 3, since the reduction in the diameter of the front band to the front wall 9 of the basket adapts the shape thereof (in the moment of maximum oscillation width) to the shape of the tank, thus resulting in the front band 18 of the basket being deeply immersed in the lye throughout the length thereof, without the front edge of the basket impacting against the tank wall.

The wall portion 13 can comprise a further rear annular band 19 arranged between the main annular band 17 and the rear wall 8 of the basket and having an average diameter lower than the average diameter of the main band. The rear band 19 is preferably substantially truncated cone-shaped with a diameter decreasing towards the rear wall 8. This allows providing, for example, a basket in which the rear and front walls have the same external diameter and in which the enlarged main band can be obtained by means of cold expansion of the initially cylindrical side wall.

To maximise both the containment volume and the immersion volume of the basket in the lye, with the lye total volume being the same, the front band 18 has an extension in the longitudinal direction of the basket which is greater than the longitudinal extension of the rear band 19 and the main band 17 has an extension in the longitudinal direction of the basket which is greater than the longitudinal extension of the front band 18 and preferably of both rear 19 and front 18 bands.

Preferably, the approximately plane interruption areas are substantially limited to the area required for connecting the blade to the side wall of the basket. It is thus advantageous that these interruption areas are provided along a more or less wide strip substantially extending from the rear wall of the basket to the front wall or at least to the vicinity thereof.

As the interruption area allows any desired orientation of the blades, such as oblique relative to the longitudinal axis X, this interruption area does not require to be formed oblique, rather it can be provided parallel to the projection of the longitudinal axis X on the side wall 7. This contributes to an easier and more accurate cold expansion method.

At the main band 17, the interruption area 14 thus preferably defines a substantially rectangular partial surface, and at the front band 18, the interruption area 14 defines a substantially parabolic partial surface, thus allowing the dragging blade 12 to be extended both in the main band and front band and to be orientated either parallel or biased relative to the longitudinal axis X of the basket.

According to the preferred embodiment, the interruption areas 14 are formed at radial reinforcement ribs 20 of the rear wall 8 of the basket, such that the folding line 16 defining the interruption area 14 provides an axial extension of the reinforcement from the radial ribs 20 through the side wall 7 to the vicinity of the front wall 9 of the basket.

Preferably, the basket comprises three interruption areas 14 that are spaced from each other at 120° angular pitch and arranged in alignment with three reinforcement ribs 20 of the rear wall 8.

In accordance with the preferred embodiment, the basket is provided with a drilling that provides, in the side wall, a pattern of many small through holes 21 that are substantially equidistant from each other and suitable to allow the lye to flow from the tank to the basket, and vice versa. Each of these small holes 21 is advantageously formed at the central vertex of a dome 22 thereof, which is for example formed by indentation, projecting to the outside of the basket. Due to the regular pattern of dome-shaped indentations 22 having 2 to 8 mm diameter, preferably 3 to 5 mm, and radially projecting to the outside of the basket, the drilled side wall 7 has a high rigidity and the edges of the small holes 21 result to be moved away from the laundry, such as to avoid an abrasive contact between the through holes 21 and the laundry.

The perforation is preferably provided only on said wall portion 13, and particularly the main cylindrical band 17 and the truncated cone-shaped band 18.

Particularly advantageously, the approximately plane interruption areas 14 are substantially provided without perforations, in order to allow the blades to be placed and orientated as desired, without having to take into account the irregular surface profile due to the perforations. In addition, those areas immediately surrounding the folding line 26 and a folding line 23 being formed between the main band 17 and the front band 18 are preferably provided without perforations 21 and indentations such as to allow the relative folding 16, 23 to be carried out along continuous lines in an easier manner.

In accordance with the preferred embodiment, the side wall 7, and particularly the main cylindrical band 17 comprises a plurality of rounded projections 24, which protrude within the basket. These rounded projections 24 are preferably provided without small through holes and have a much larger diameter than that of the small holes and domes thereof. Preferably, the rounded projections also have a dome or cap shape (convex as seen from within the basket) which is obtained by means of indentation. These rounded projections 24 have a diameter ranging between 1 cm and 3 cm, preferably about 2 cm, and a height ranging between about 1 mm and 4 mm, preferably 2 mm, and exert a soft dragging effect on the laundry in contact with the side wall 7 of the basket 6.

Experimental tests have shown that a particular arrangement of the rounded projections 24 unusually contributes to an improved washing effectiveness, particularly on delicate garments. This arrangement of the rounded projections 24 is shown in FIGS. 7A, 7B and 7C and provides for a circumferential succession of individual groups of rounded projections 24 (in which each group advantageously comprises three projections 24) which define, in turn, an arrow-tip pattern, i.e.

a triangular arrangement with the triangle vertex being oriented in the circumferential direction of the side wall 7.

Figure 7A:
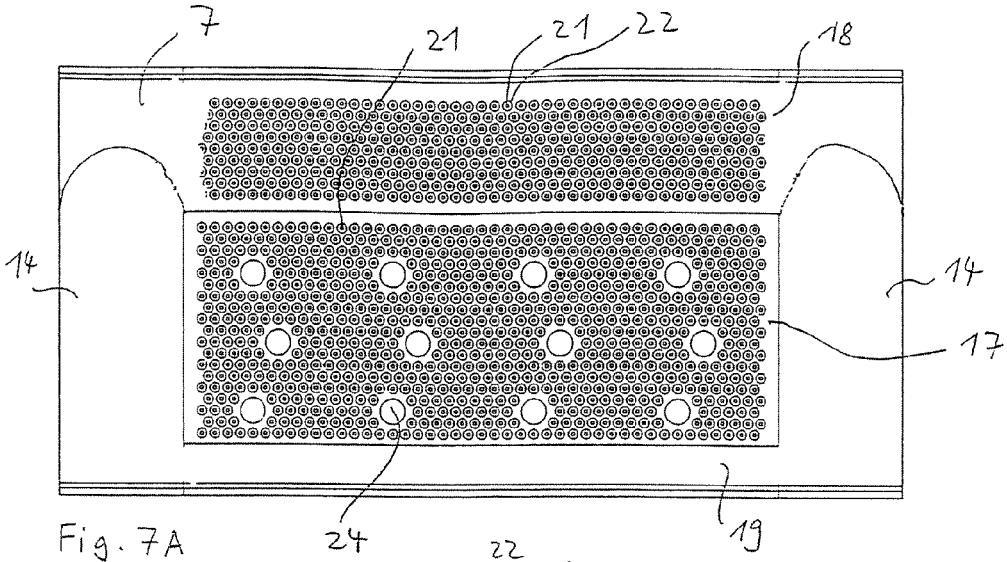
FIGS. 7A, 7B, 7C are partial views of the side wall of the basket according to an embodiment of the invention as developed in a hypothetical development plane.
Figure 7B:
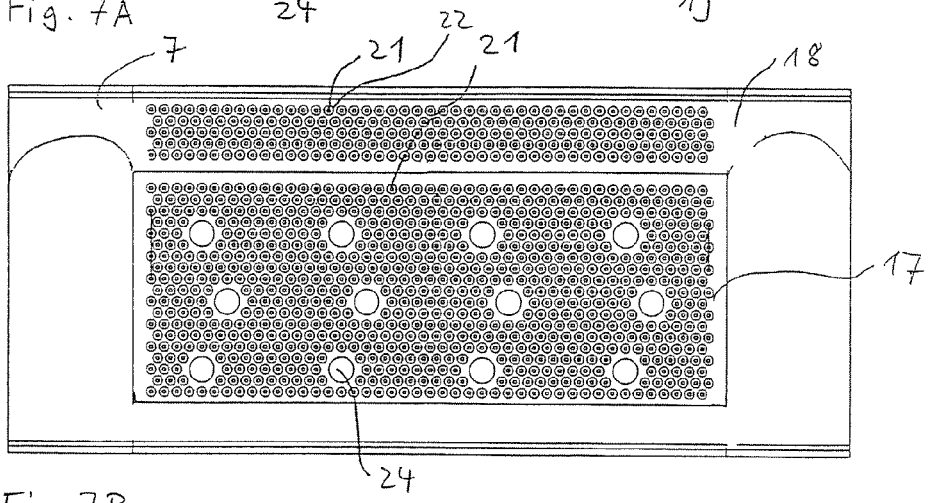
Figure 7C:
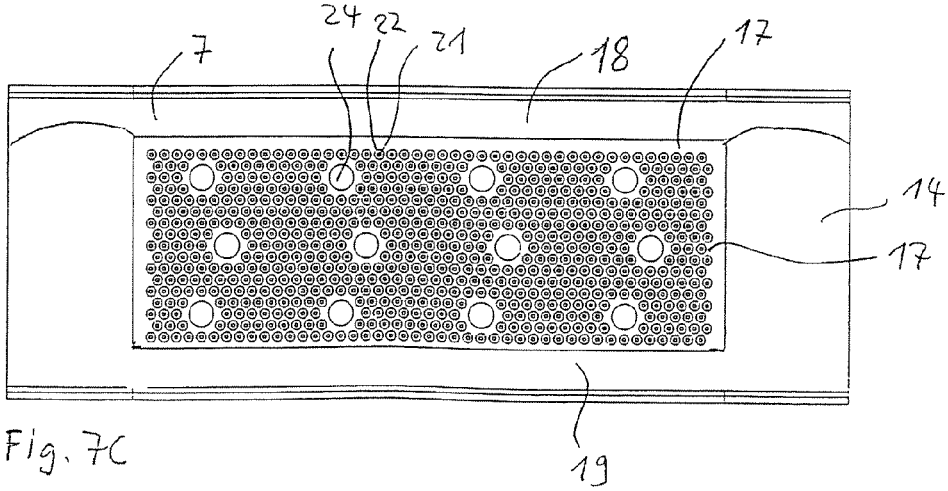
Figure 8:
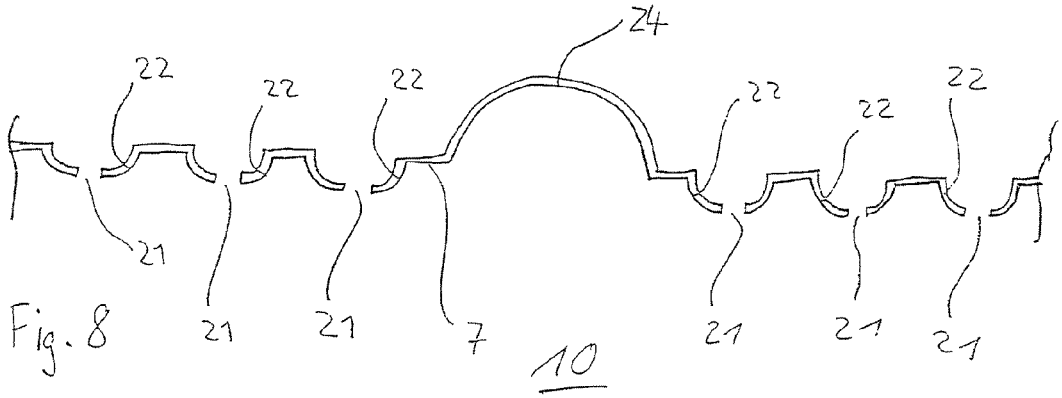
FIG. 8 is a partial sectional view of the side wall of a basket according to an embodiment of the invention.

FIGS. 7A, 7B and 7C show parts of the side wall 7 of baskets having different depths (or, in other words, longitudinal extensions), wherein the main band 17 preferably has the same longitudinal extension, whereas the longitudinal extension of the front band 18 having the shape of a truncated cone changes according to the total depth of the basket. In the case of FIG. 7C, this front band 18 is very shallow and not provided with drilling.

Figure 6:
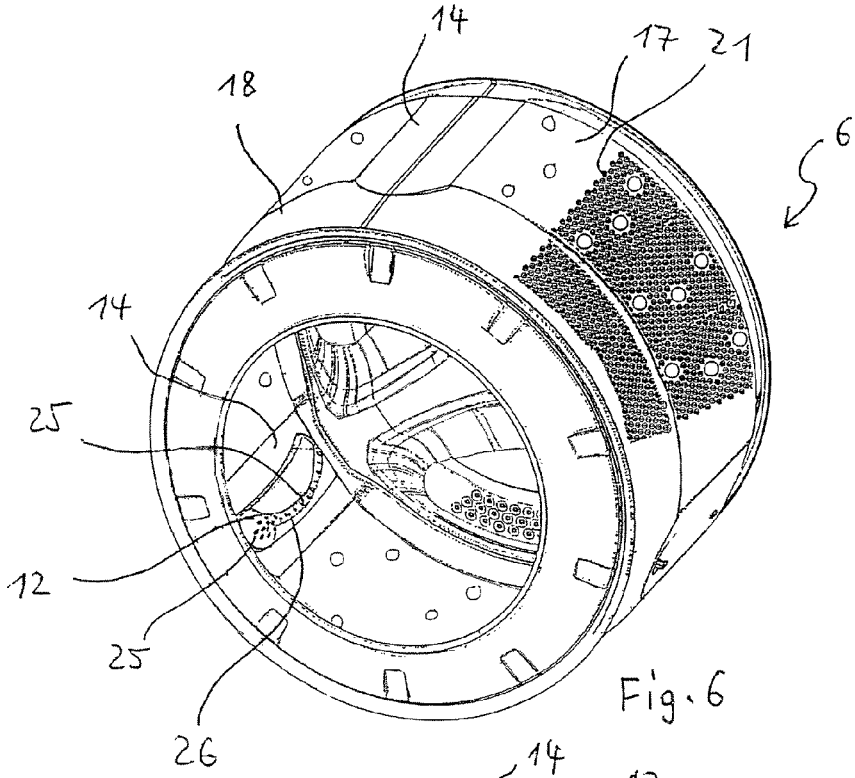
FIG. 6 is a perspective view of the basket from FIG. 4.
Figure 5:
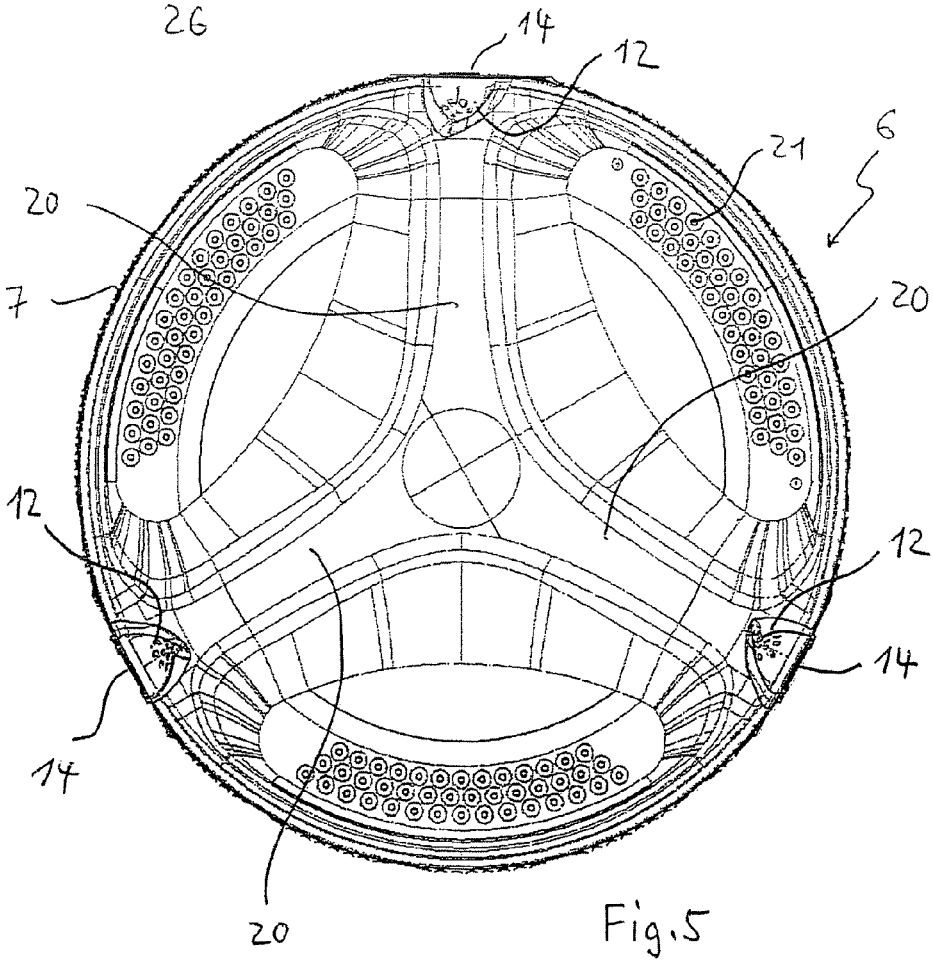
FIG. 5 is a cross-sectional view of the basket from FIG. 4.

Finally, in order to avoid said problems of the laundry impacting against the traditional dragging blades, a blade shape has been devised which is particularly suited for large-sized baskets and high number of revolutions. This blade 12, such as shown in FIG. 6, has a bend along the longitudinal extension thereof, such as to give the laundry, in addition to the well known lifting movement, a further movement in the longitudinal direction of the basket. This greatly contributes to a better mixing of the laundry during washing and drying while preventing the individual items (particularly the delicate ones) from remaining for a long time in areas greatly exposed to the mechanical action of the basket.

This curved blade 12 has, as is known, a plurality of holes 25 for the lye to pass therethrough, which is accumulated in the lower part of the tank and released when the blade is in a raised position. Preferably, these holes 25 comprise a first set of holes arranged along a longitudinal ridge 26 of the blade and a second set of holes arranged at an (either front or rear) end of the blade 12 such as to enhance the feeding of lye within the basket in the vicinity of this end as compared with the remaining areas of the blade.

From the detailed description of the invention as provided above, those skilled in the art may appreciate how the combination of the individual characteristics can conciliate in a synergic manner the various structural and concept requirements occurring in relation with the use of large-volume baskets in high-performing washing machines and dryers, particularly with a high number of revolutions.

In brief, it should be particularly noted that the plane interruption areas defined by a folding line from the surrounding continuity areas allow:

obtaining an extension of the reinforcement from the radial reinforcement ribs through the side wall of the basket to the vicinity of the front wall;

avoiding buckling events of the snap-through type at the blades; and they allow the dragging blades to be placed and secured such as to avoid undesired impact effects on the laundry, without requiring a range of variously shaped blades in order to allow the latter to be adapted to the three-dimensionally curved shape of the side wall of the basket.

In addition to this effect, the volume barycentre of the basket is shifted to the support point thereof, which implies a reduction in the width of the oscillations of the basket, with the load and number of revolutions being equal, which allows reducing the safety distance between the basket and the tank and thus a better exploitation of the lye contained within the washing tank. Furthermore, due to the mixed cylindrical-truncated cone shape of the basket, the latter emerges with an overall larger volume thereof in the lye without impacting against the wall of the washing tank.

These main characteristics are advantageously combined with the particular pattern of the through holes 21 in the side wall 7 and particularly with the rounded projections 24 facing the inside of the basket, which allow carrying out a very strong washing (which can be also obtained due to said structural characteristics of the basket) also on delicate garments, without the risk of damage due to excessive friction between the laundry and the side wall of the basket. Finally, the curved shape of the dragging blades 12 allows eliminating the undesired effects that occur with traditional blades at high-speed rotation of the basket.

It should be understood that variations and/or additions may be provided to what has been described and illustrated above. First, the present invention not only can be applied to washing machines with biased-axis tanks, such as those in the example described above, but also to washing machines with horizontal axis, washer-dryers, and dryers.

Further variants and/or additions will be readily within the capability of those skilled in the art, without however departing from the scope of protection as defined in the annexed claims.

What is claimed is:

1. A loading basket (6) for a washing machine (1), washer-dryer, dryer and the like, comprising:

a rear wall (8) to be secured to a support structure (4) of the basket;

a front wall (9) opposite the rear wall (8), a side wall (7) extending about a longitudinal axis (X), which is the axis of rotation of the basket and is connected to the rear (8) and front (9) walls to define an inner space (10) of the basket, one or more dragging blades (12) being arranged on the side wall (7) and projecting to the inside of the basket, wherein the side wall (7) comprises a substantially cylindrical and/or truncated cone-shaped wall portion (13), wherein said wall portion (13) comprises one or more approximately plane interruption areas (14) extending from a rear area of the side wall (7) close to the rear wall (8) to the vicinity of the front wall (9), wherein said dragging blades (12) are connected to said interruption areas (14), wherein said approximately plane interruption areas (14) are obtained by means of cold expansion of the side wall (7) from a substantially cylindrical plate ring, such that the approximately plane interruption areas (14) have a bending radius that is greater than and has the same sign as the bending radius of adjacent cylindrical and/or truncated cone-shaped continuity areas (15).

2. The basket (6) according to claim 1, wherein the side wall (7) is shaped such that said interruption areas (14) approximately extend in a plane intersecting the cylindrical and/or truncated cone shape of said wall portion (13).

3. The basket (6) according to claim 1, wherein said approximately interruption areas (14) border on cylindrical and/or truncated cone shaped adjacent continuity areas (15) of the wall portion (13) along a folding line (16) that is substantially provided without steps or large transition areas.

4. The basket (6) according to claim 3, wherein along said folding line (16), the radius of the side wall (7) relative to the longitudinal axis (X) of the basket coincides with the corresponding radiuses both of the continuity area (15) and interruption area (14).

5. The basket (6) according to claim 1, wherein said approximately plane interruption area (14) has a slight concavity as seen from within the basket.

6. The basket (6) according to claim 1, wherein said wall portion (13) comprises a main annular band (17) and a front annular band (18) arranged between the main band (17) and the front wall (9) of the basket, wherein the main band (17) has an average diameter that is grater than the average diameter of the front band (18) such that the barycentre of the inner volume being defined by the basket is shifted to the rear wall (8).

7. The basket (6) according to claim 6, wherein said main band (17) has a substantially cylindrical shape, except for the approximately plane interruption areas, and said front band (18) has a substantially truncated cone shape with a diameter decreasing towards the front wall (9), except for the approximately plane interruption areas (14).

8. The basket (6) according to claim 6, wherein said wall portion (13) further comprises a rear annular band (19) arranged between the main annular band (17) and the rear wall (8) of the basket, said rear band (19) having an average diameter lower than the average diameter of the main band (17).

9. The basket (6) according to claim 8, wherein said rear band (19) is substantially truncated cone-shaped with a diameter decreasing towards the rear wall (8).

10. The basket (6) according to claim 6, wherein the front band (18) has an extension in the basket longitudinal direction which is greater than the longitudinal extension of the rear band (19).

11. The basket (6) according to claim 6, wherein the main band (17) has an extension in the basket longitudinal direction which is greater than the sum of the longitudinal extensions of the front (18) and rear (19) bands.

12. The basket (6) according to claim 6, wherein at the main band (17), the interruption area (14) defines a substantially rectangular surface and, at the front band (18), the interruption area defines a substantially parabolic surface.

13. The basket (6) according to claim 1, wherein said interruption area (14) overlaps both the main annular band (17) and the front annular band (18).

14. The basket (17) according to claim 1, wherein the dragging blades (12) are secured in the interruption areas (14) and have a substantially curved shape in the longitudinally direction of the basket.

15. The basket (6) according to claim 1, wherein the interruption areas (14) are formed at radial reinforcement ribs (20) of the rear wall (8) of the basket, such that the folding line (16) defining the interruption area (14) provides an axial extension of the reinforcement from the radial ribs (20) through the side wall (7) to the vicinity of the front wall (9) of the basket.

16. The basket (6) according to claim 1, wherein the side wall has:

a perforation (21) at said main band (17) and said front band (18), wherein the individual small through holes (21) of the perforation are arranged at the vertex of respective domes (22) projecting to the outside of the basket;

a plurality of rounded projections (24) in the shape of spherical dome, which is provided without through holes, and which project to the inside of the basket, wherein the interruption areas (14) are provided without small through holes (21) and rounded projections (24).

17. The basket (6) according to claim 1, comprising three interruption areas (14) that are spaced from each other at 120° angular pitch.

18. A washing machine (1), washer-dryer, dryer or the like, including a basket (6), said basket (6) comprising:

a rear wall (8) to be secured to a support structure (4) of the basket;

a front wall (9) opposite the rear wall (8), a side wall (7) extending about a longitudinal axis (X), which is the axis of rotation of the basket and is connected to the rear (8) and front (9) walls to define an inner space (10) of the basket, one or more dragging blades (12) being arranged on the side wall (7) and projecting to the inside of the basket, wherein the side wall (7) comprises a substantially cylindrical and/or truncated cone-shaped wall portion (13), wherein said wall portion (13) comprises one or more approximately plane interruption areas (14) extending from a rear area of the side wall (7) close to the rear wall (8) to the vicinity of the front wall (9), wherein said dragging blades (12) are connected to said approximately plane interruption areas (14), wherein said approximately plane interruption areas (14) are obtained by means of cold expansion of the side wall (7) from a substantially cylindrical plate ring, such that the approximately plane interruption areas (14) have a bending radius that is greater than and has the same sign as the bending radius of adjacent cylindrical and/or truncated cone-shaped continuity areas (15).

* * * * *